US005989157A

United States Patent [19]

Walton

[11] Patent Number: 5,989,157

[45] Date of Patent: Nov. 23, 1999

[54] EXERCISING SYSTEM WITH ELECTRONIC INERTIAL GAME PLAYING

[76] Inventor: Charles A. Walton, 19115 Overlook Rd., Los Gatos, Calif. 95030

[21] Appl. No.: 08/893,487

[22] Filed: Jul. 11, 1997

Related U.S. Application Data

[63] Continuation-in-part of application No. 08/692,740, Aug. 6, 1996, abandoned.

[51] Int. Cl.[6] ..... A63B 21/00

[52] U.S. Cl. ..... 482/4; 482/1; 482/900; 482/902

[58] Field of Search ..... 482/1–9, 900, 482/902, 901

[56] References Cited

U.S. PATENT DOCUMENTS

| | | | |
|---|---|---|---|
| 4,867,442 | 9/1989 | Mattews | 482/901 |
| 4,911,427 | 3/1990 | Matsumoto et al. | 482/3 |
| 5,215,468 | 6/1993 | Lauffer et al. | 482/3 |
| 5,538,486 | 7/1996 | France et al. | 482/4 |

OTHER PUBLICATIONS x References in applicant's pror appication 08/520,164 and 08/692,740.

*Primary Examiner*—Richard J. Apley
*Assistant Examiner*—Glenn E. Richman

[57] ABSTRACT

An exercise and game playing system combined, forming a method in which the user gets large muscle physical exercise while at the same time is challenged with game play. There is a torso and limb mounted electronic section incorporating accelerometers, strain gauges, and other instruments, and a microprocessor, and a short range radio or wire link to a stationary base station and a display station. Body activity and exercise produce a display icon responsive to the degree and vigor of body activity. The display is a TV type screen or a head band mounted assembly or goggles of a virtual reality system. The accelerometer signals are double integrated and manipulated to produce useful display on the screen. There is net cursor advancement activity on the screen even when the body returns to the same location, accomplished by introduction of a dead zone in the accelerometer integration paths. A score is kept of how well the user follows the game commands, such as staying within the boundaries of a screen track, or avoiding collision with game obstacles. There are special effects for games, such as triggering the imaginary throw of a javelin or discus, or firing imaginary weapons or setting up a military defense, or imaginary enemies. The display effects are proportional to the vigor of the exercise, and are also proportional to the product of acceleration and applied muscle tension. There is a music source and sounds responsive to exercise effort, and a voice report of the status of the exercise regime and the value of effort achieved. Other elements include: handles for applying force to strain gauges; heart beat sensors, nerve activity and muscle sensors, buttons, and switches.

23 Claims, 13 Drawing Sheets

FIG. 16
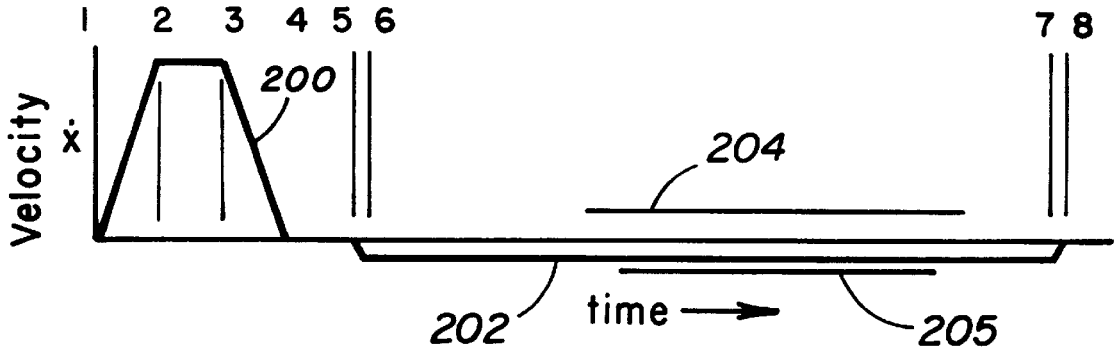
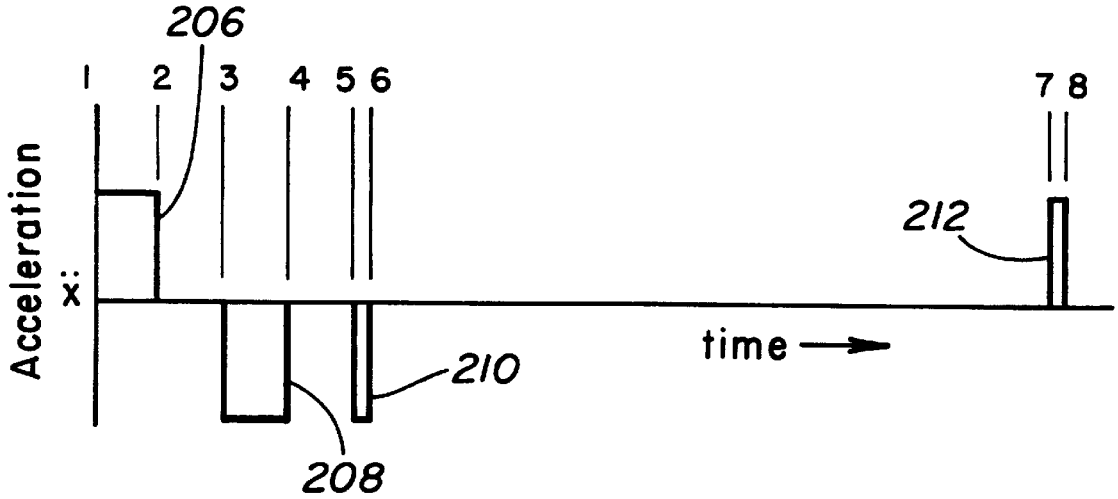
FIG. 17

FIG. 18
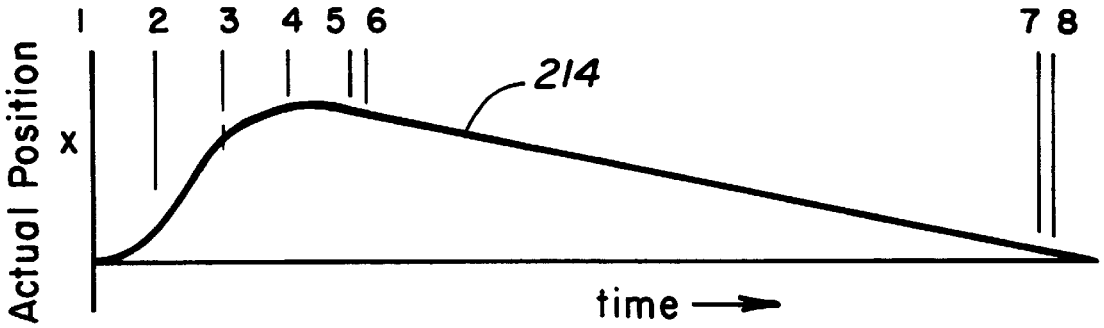
FIG. 20
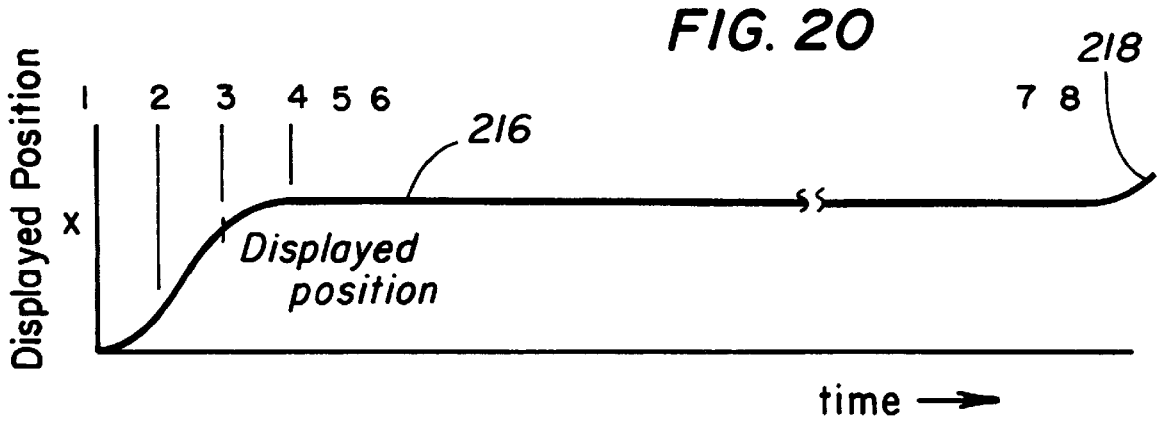
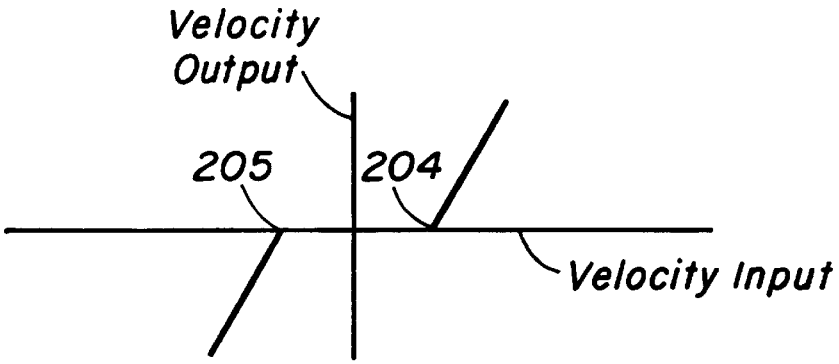
FIG. 19

EXERCISING SYSTEM WITH ELECTRONIC INERTIAL GAME PLAYING

This is a continuation-in-part application to the application entitled: EXERCISING SYSTEM WITH ELECTRONIC INERTIAL GAME PLAYING, Ser. No. 08/692,740, docket ID128, Filed Aug. 6, 1996. Application abandoned:

BACKGROUND AND FIELD OF THE INVENTION

Electronic games are popular and interest is growing. The operator sits before a screen, and uses a hand controller, and sometimes also a foot and head controller, to steer and operate while watching the screen. Dexterity is developed between hand and eye. There are also sound effects of engine noises and crashes. Arcades feature these games, usually coin operated. There are many arcade games, a popular example of which is vehicle driving skill over a rapidly moving road. The road image interacts with the user as he drives a vehicle. The vehicle may be a racing car, spaceship, etc. In these arcade games much skill can be developed in terms of coordination of eye with hand movement.

For home use, among the electronic games are the Nintendo family of games, including games such as Mario Brothers and Super Mario. In the shooting versions of Nintendo games, one acquires hand-eye coordination while pointing a pistol or rifle at a moving screen target. Many people believe these games are a waste of time, having no transferable skill to other activities in life, nor any particular health benefits. Lacking in these electronic games are the benefits of large body muscle exercise.

Also, over the past ten to twenty years, health clubs and spas have become popular for providing the health benefits of large muscle exercise and aerobic exercise. There are weight training and isometric and isotonic exercises which are recognized as valuable health habits. Popular devices include stationary bicycles, walking machines using a treadmill, stepping machines, and weight lifting. Also, at the health clubs, there are healthy interactive games such as racquetball and tennis.

One problem with weight training is the need to purchase and keep on hand weights of various values. Also, just muscle exercises frequently become boring and are abandoned.

Muscle resistance devices not requiring weights, but including springs or rubber bands, against which the body works, are available. This is known as "isotonic" exercising. These devices are portable but are not interesting to use. Another form is that of a bar fixed in place, against which one stresses the muscles, with little movement. The fixed bar system is known as "isometric" exercising., which is also uninteresting.

At health clubs, several types of electronic interaction have been tried. Walking machines report pace and distance covered. Heart beat rate is measured and sensed several ways. A voice report with audible heart beat and audible muscle effects adds interest.

There is a need to add to electronic game entertainment the larger benefits of whole body exercise, or conversely, to add to large muscle exercise the fun of electronic game entertainment.

PRIOR ART DISCLOSURES

U.S. Pat. No. 3,424,005, entitled Exercising Device with Indicator, by Brown, is aimed at developing a user's back and leg, with no muscular motion allowed. It does not add value to arms and mobile portions of the shoulders. It is limited to up and down forces only, does not provide for verbal or tone response or sound, and has no included acceleration sensing.

U.S. Pat. No. 3,929,335, entitled Electric Exercise Aid, Malick, relates to measuring motion in the form of rotation at a joint, and encouraging healing of the joints. It does not measure stress nor any other motions. No acceleration sensing, sound or voice production from heart beat impulses or muscle artifact pulses is included U.S. Pat. No. 3,995,492, entitled Sound Producing Isometric Exerciser, by Clynes. Describes an exerciser in which a roughly dumbbell shaped object emits sounds when manually stretched or compressed.

U.S. Pat. No. 4,647,038 entitled Exerciser with Strain Gauges, by Neffsinger, uses conventional bar bells with strain gauges attached to report stress. A regular set of weights and a bar is needed for its use. There is no practical portability, acceleration sensing, and no sound or voice production from heart beat impulses or muscle artifact pulses is included.

U.S. Pat. No. 5,054,774, entitled Computer Controlled Muscle Exercising Machine . . . , by Belssito, describes a whole body system, with seat. It is not portable and does not provide for acceleration sensing.

U.S. Pat. No. 5,099,689, entitled Apparatus for Determining Effective Force Applied by an Oarsman, by McGinn, is limited to rowing equipment and oar force measurement and doe not acceleration sensing is included. No sound or voice production from heart beat impulses or muscle artifact pulses is included U.S. Pat. No. 5,104,120, Exercise Machine Control System, by Watterson, et al. This invention describes a system for automatically adjusting the load (also called resistance) against which a person using the exerciser equipment must work, and it also measures pulse rate. It is relatively costly equipment, and does not provide for acceleration sensing, nor sound or voice production from heart beat impulses or muscle artifact pulses.

U.S. Pat. No. 5,108,096, entitled Portable Isotonic Exerciser, by Ponce, is simple manipulator or squeeze device for the hand, with no electronic display, no sound generation, no acceleration sensing, and no sound or voice production from heart beat impulses or muscle artifact pulses.

U.S. Pat. No. 5,137,503, entitled Exercise Hand Grip Having Sound Means . . . , by Yeh, turns on pre-recorded entertainment sound when hand grips are tightened, and counts cycles, but does not measure or display the magnitude of the muscle force applied, nor encourage the user by proportional or numeric verbal or visual feedback, and does not include acceleration sensing, nor sound or voice production from heart beat impulses or muscle artifact pulses.

U.S. Pat. No. 5,180,352, entitled Appliance Used in Exercising Arms and Legs, by Seeter, develops sound in accordance with speed of motion. It does not measure stress or muscle power, has no visual display, has acceleration sensing, has no sound or voice production from heart beat impulses or muscle artifact pulses.

SUMMARY DESCRIPTION

An object of the present invention is to provide an electronic system which plays entertaining games with the user and at the same time provides exercise and physical stimulation. A preferred embodiment of the invention has two primary parts, a transmitter which is worn on the body, and a base station for providing a display of activity of both the user and opponents. The transmitter includes a set of transducers attached to the user's body, e.g. to the waist, arms, and/or legs.

The transducers include accelerometers, strain gages, and muscle potential sensors, and user operated selective switches for sensing motions and muscle stress of the users body parts.

A microprocessor is included to provide flexibility in display and response.

The transducer values are converted into the direction of motion of objects on the display screen, and into the velocity of the objects. The objects strike assumed targets. The transducer values are passed through a base line noise rejection filter, or threshold block, which passes large acceleration values but rejects small values. By moving his body vigorously the user can make the screen object progress over various parts of the screen. The transducer signals incorporate both X and Y accelerometer signals, which establish the direction or vector of projectiles, and of the displayed body motion.

Various athletic equipment, such as javelins or discuses, weapons, tools, etc., are options to make the physical workout variable and interesting, and to exercise differing sets of muscles.

An optional configuration of a preferred embodiment has two handles for manual gripping while allowing full travel and isotonic exercising of the users shoulder and arms. Between the handles are strain gages. The two handles are movable such that they can be pressed together or pulled apart, and the strain gages report the stress and strain. The strain gage values interact with the accelerometer values to improve the game score or speed. The handles carry electrodes which provide for sensing of the heart beat and muscle tension.

An advantage of the present invention is that it provides simultaneously healthy physical large muscle exercise and the fun of a computer game.

A further advantage of the present invention is that it provides complex paths which require vigorous muscular motion to follow, and reports on the precision with which the user follows the path and the speed at which it is followed.

A further advantage of the present invention is that it provides visual and audible display of the exercise levels reached and/or maintained for prompt eye and ear evaluation.

A further advantage of the present invention is that it provides targets which require both skill and muscular vigor to strike and provides concurrent reports on the level of success.

A further advantage of the present invention is that it reports to the user numerical value of stress, acceleration, torque, and quantity of exercise cycles.

This continuation adds the following summary features to the original application:

1. The ability of the body movement to establish the direction of motion of a game object, to create hypothetical game attacks on a target.

2. The power and speed of motion of the game project is related to the vigor of the body motion.

3. The dead zone feature necessary to create motion on the display is applied to both velocity and acceleration terms.

BRIEF DESCRIPTION OF THE DRAWINGS (Note about the figures: For purposes of completeness and aid in reading this application, the figures which appeared in the original application Ser. No. 08/692,740, docket ID128, referred to as '740, are repeated, with new figure numbers as noted later in the Description.)

FIG. 16 illustrates a velocity profile;

FIG. 17 illustrates an associated acceleration profile;

FIG. 18 illustrates an associated base station actual position;

FIG. 19 illustrates base line suppression, or dead zone;

FIG. 20 illustrates an associated base station displayed position;

DETAILED DESCRIPTION OF PREFERRED EMBODIMENTS

Figure 1:
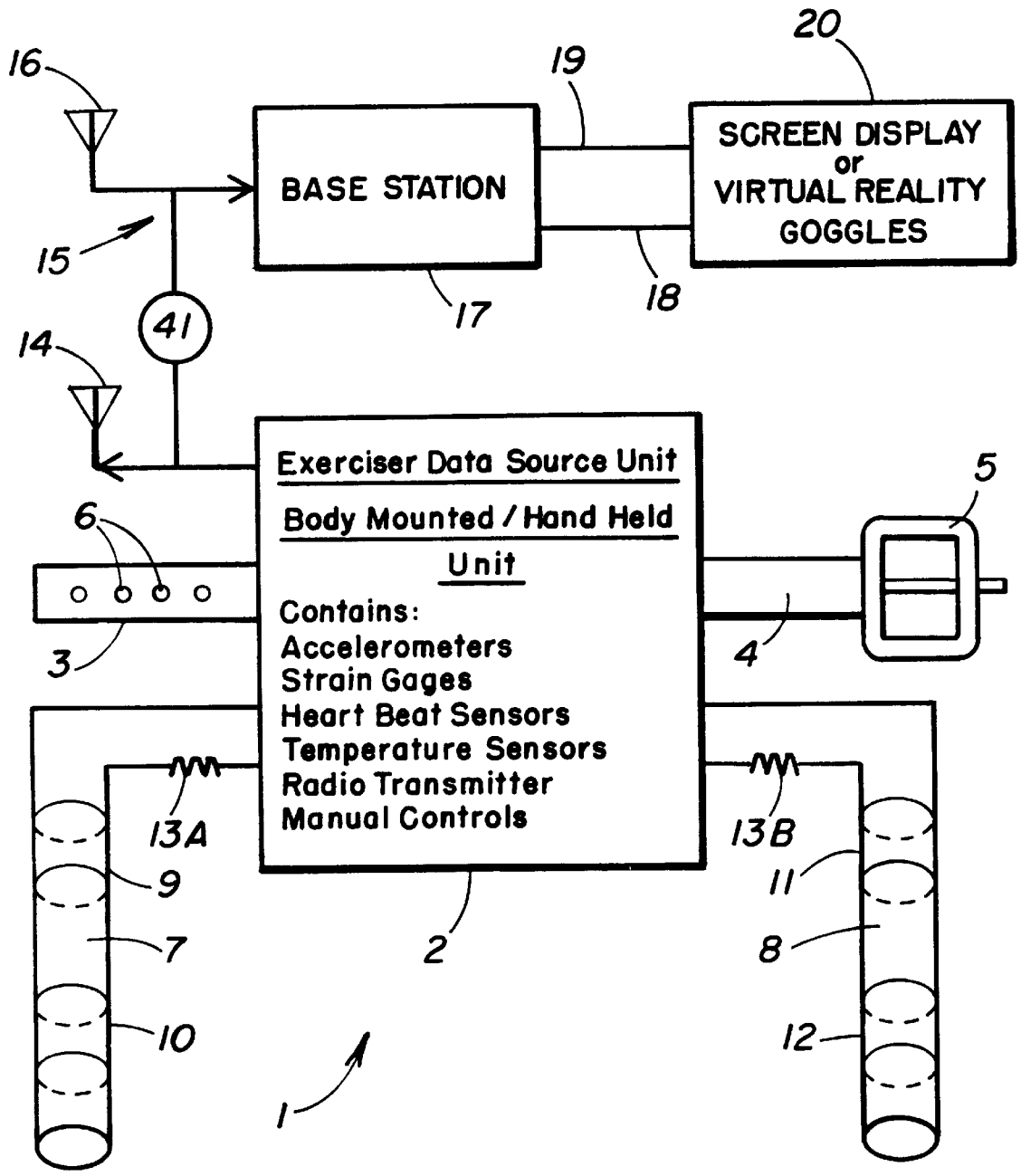
FIG. 1 is a diagram of the basic system showing the body transmitting unit and receiving unit.

FIG. 1 (referred to as FIG. 1 in '740) shows a basic system 1 including a transmitting unit 2 worn by a user, and the basic receiving and display station 15. The unit 2 may be mounted to the user's waist, wrist, etc., and carries various transducers, typically accelerometers and strain gages, manual controls, and a small radio digital or analog data transmitter, or line drivers if a coupling cable is used. The unit 2 may be mounted with a plurality straps 3 and 4 with a buckle 5 and mating holes 6. Mounted to unit 2 are a pair of optional handles 7 and 8, with a pair of strain gages 13A and 13B mounted in their length. A plurality of metal pads 9, 10, 11, and 12 sense and report the heart beat. Data from a base station 17 is communicated over a pair of lines 18 and 19 the to the display unit 20.

Figure 2:
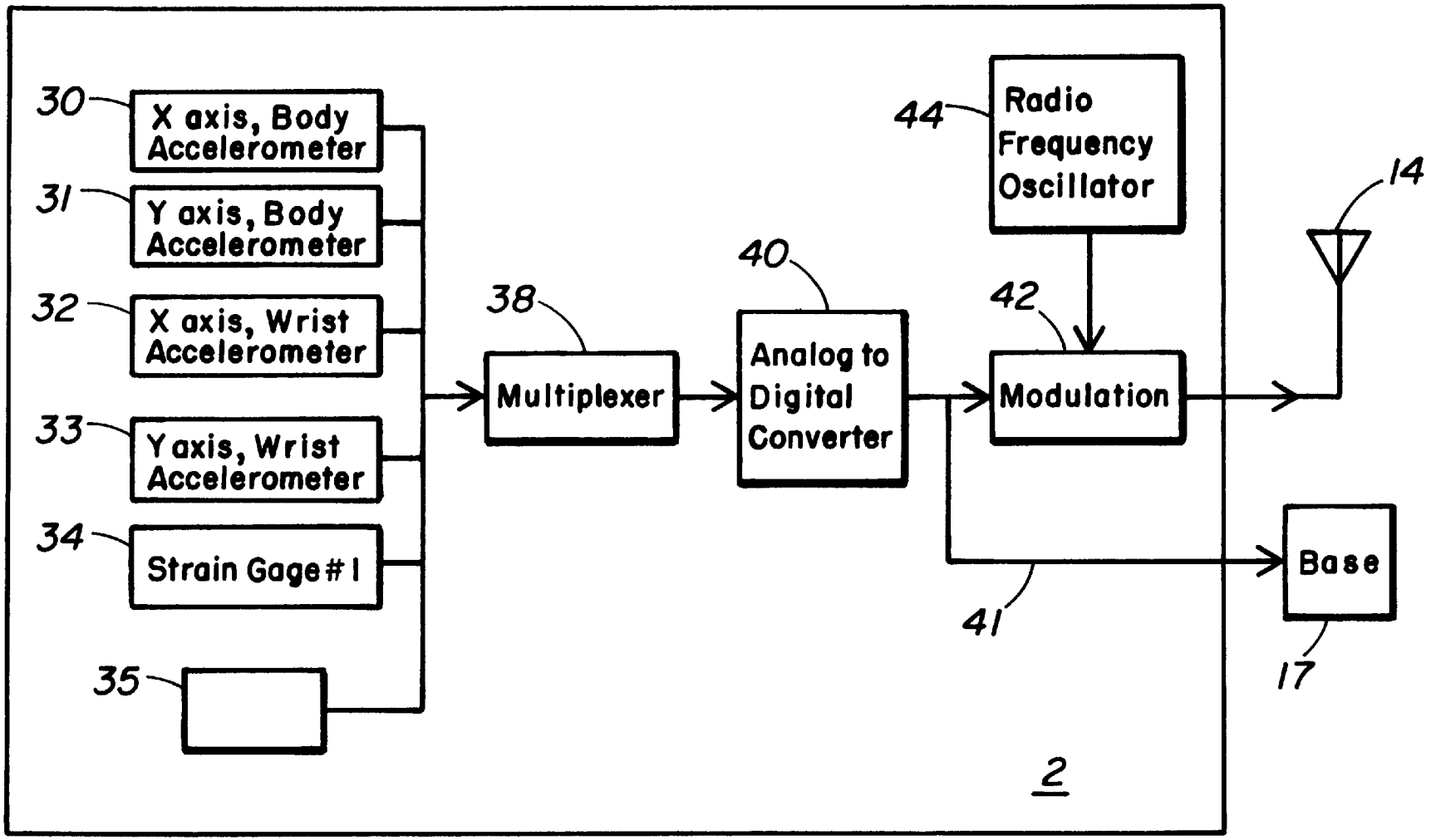
FIG. 2 is a block diagram of the basic body unit of FIG. 1.

FIG. 2 (new Figure not in '740) is a block diagram of the basic body-mounted transmitting unit 2 and includes a set of transducers 30 to 33. The transducers 30 to 33 include accelerometers, measuring acceleration on the body (torso)

and wrist in the X and Y axes, and 34 is a strain gage for measuring strain from the hands. Other instruments 35 may be included for measuring temperature and sensing heart beat and muscle impulses. The transducer signals are typically analog in form, but digital versions may be used. These signals are connected in sequence, commonly known as multiplexing, by multiplexer 38, and then converted from analog to digital by analog-to-digital converter 40.

The stream of digital pulses are sent to base station 17 by either of two routes. The digital pulse signals may travel directly by a cable 41, also referred to as an umbilicus. The cable 41 is simple and reliable, but is somewhat inhibiting for use during active exercise. The alternative means of transmitting data is by a radio frequency link, formed on the transmitting side of a radio frequency oscillator 44, a modulator 42, and a transmitting antenna 14.

Figure 3:
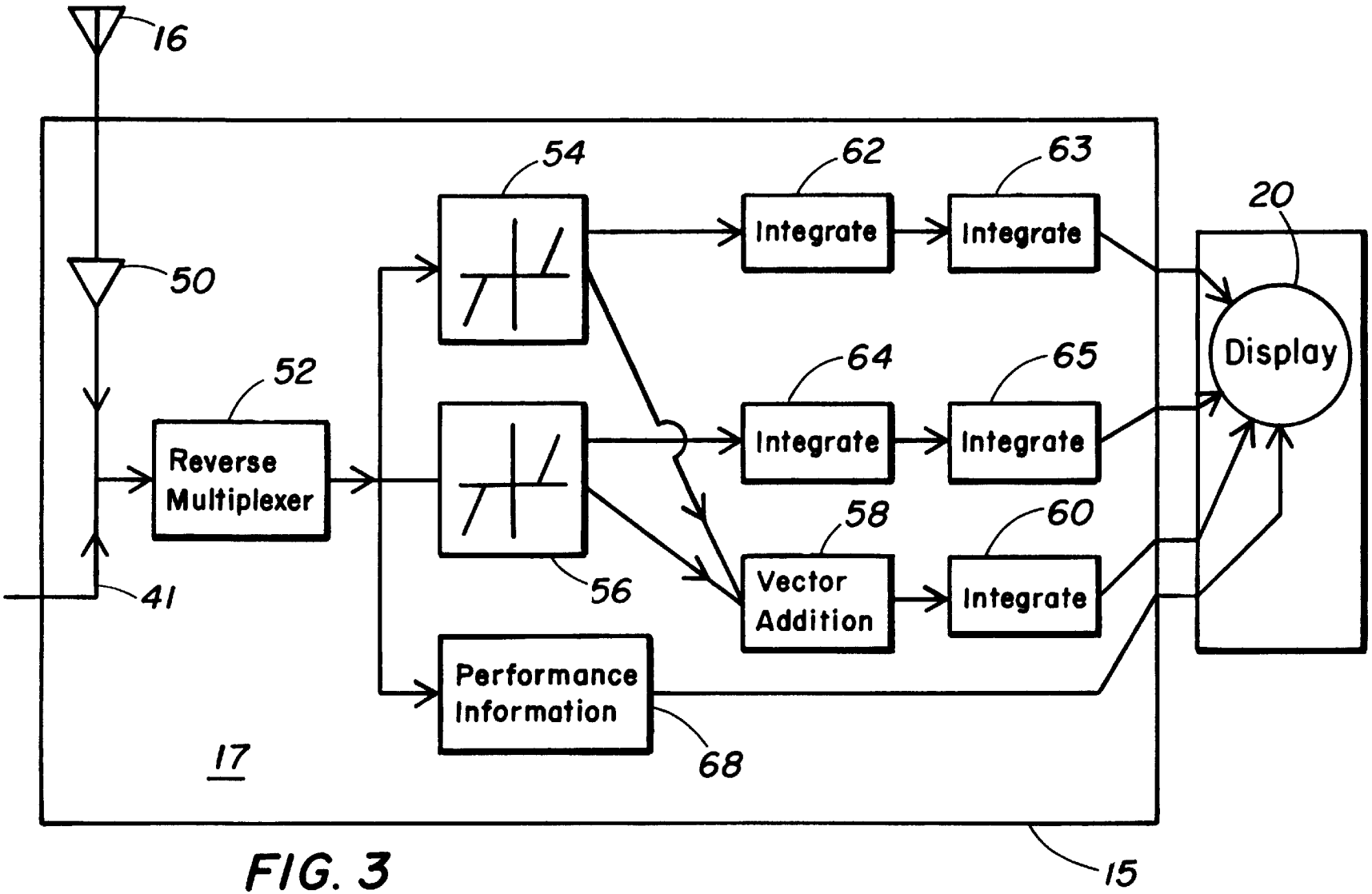
FIG. 3 is a block diagram of the basic receiver.

FIG. 3 (new Figure not in '740) shows the elements of the receiving unit or base station 15, comprised of antenna 16, data processing section 17 and display 20. Antenna 16 brings the data in via a pre-amplifier 50. The data is reverse multiplexed in inverse-multiplexer 52 and distributed to the individual data processing channels.

The X axis accelerometer value is sent through base clipper block 54, also referred to as zero suppression, which selects the more powerful accelerometer signal, as described in more detail later in FIG. 8. The acceleration value from block 54 is integrated in integrator 62 to produce an X axis velocity signal. The X axis velocity signal is integrated in integrator 63 to produce an X axis position signal.

Figure 10:
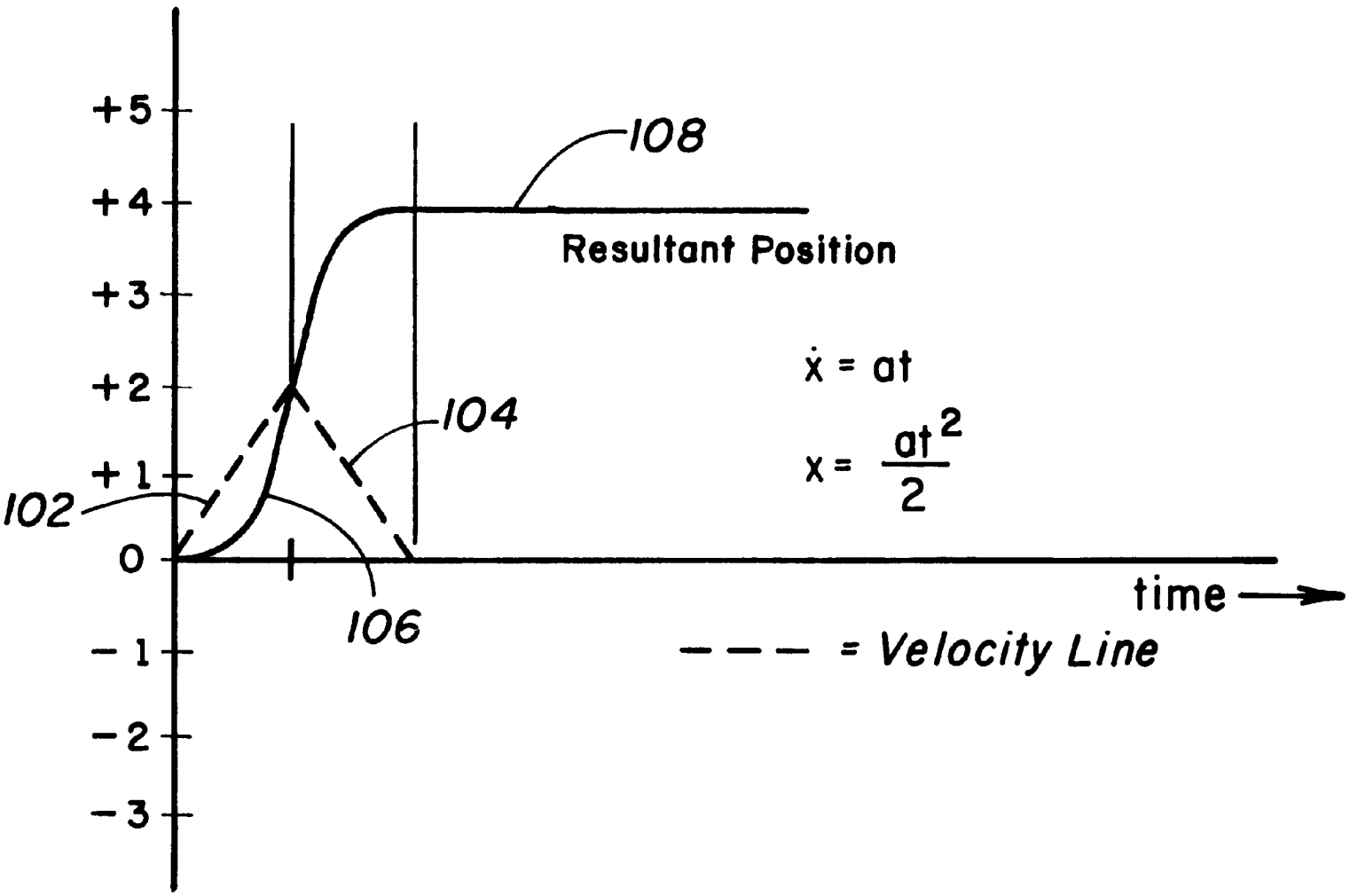
FIG. 10 illustrates an associated velocity profile and position display.

Similarly, the Y axis accelerometer value is sent through base clipper block 55, which selects the more powerful accelerometer signal, as described in more detail later in FIG. 8. The acceleration value from block 56 is integrated in integrator 64 to produce a Y axis velocity signal. The Y axis velocity signal is integrated in integrator 65 to produce an Y axis position signal The X and Y position signals are sent to display 20 which combines the X and Y position signals to produce a Cartesian coordinate display of a single position point. The position display plot resulting from these integration steps is shown in FIG. 10, discussed later.

Other performance information such as strain gages and user switch commands enter through the block 68 and are displayed on screen 20 as appropriate. For example, the strain gages 13A and 13B respond to the applied pressure on the handles 7 and 8. The values of these readings multiply in a multiplier 160 the display values, as discussed later under FIGS. 14 and 15.

The X and Y acceleration values from blocks 54 and 56 are also sent to a vector addition block 58, which produces a vector acceleration value, and an integrator 60 which further produces a vector velocity value, described further in FIGS. 7 through 13. The vector result controls the direction and power of a simulated projectile 134 pointed at target 136, described in FIG. 13, and displayed on the screen. 20.

FIGS. 2 and 3 also shows the optional radio frequency link for transmitting data from the body nit 2 to the base station 17. In the base station 17, shown in FIG. 3, there is a receiving antenna 16, and radio receiver and amplifier 50. The digital signal is reconstructed for processing by base station 17. There is then no need for umbilicus connection 41 shown in FIGS. 2 and 3.

Figure 6:
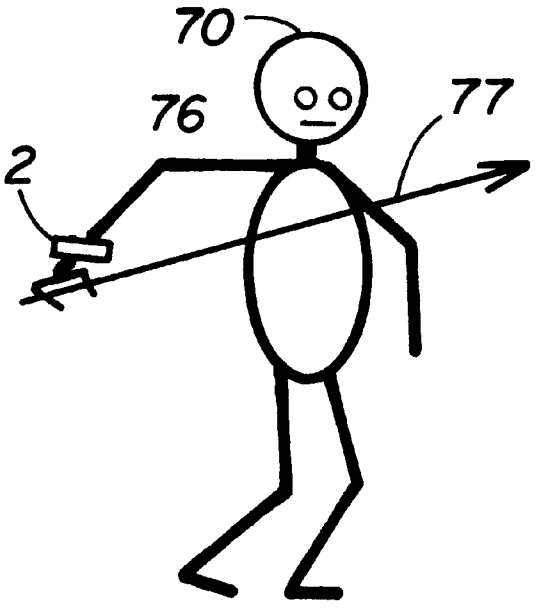
FIG. 6 illustrates a body prepared to thrust with arm and wrist motion.
Figure 5:
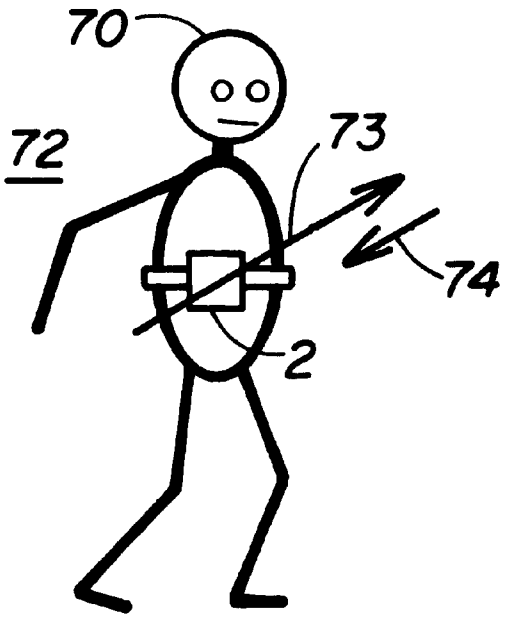
FIG. 5 illustrates a user at end of firing thrust.
Figure 4:
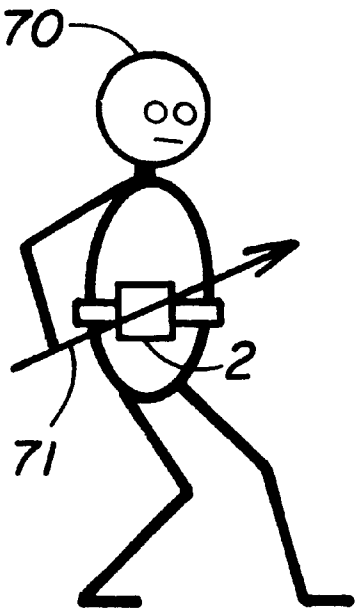
FIG. 4 illustrates a user wearing a waist unit, in position at beginning of firing thrust.

FIGS. 4, 5 and 6 (new Figures not in '740) show the various exercise gyrations the user goes through to enjoy this invention. FIG. 4 illustrates a user 70 wearing the basic body unit device 2. The user 70 is in the left hand "get ready" position. In FIG. 5 the user is in a new position identified as 72. Arrow 71 represents the motion of the sensing device 2 in the process of this body shift. The user who is performing vigorously will have moved rapidly from left to right (observer's point of view) and also risen slightly. The accelerometers 30 and 31 in body unit 2 report this motion. An arrow 73 also represents this motion. Arrow 74 represents the return motion of the body from position 72 to the original position of FIG. 4. The return motion is usually less vigorous and so arrow 74 is smaller.

The accelerometers 30 to 33 shown in FIG. 2 put out signals as shown later in FIGS. 7, 8, and 9 (7, 8, and 9 are new Figures not in '740). FIGS. 4 and 5 represent two consecutive positions of the body 70. The consecutive positions, after processing by the system, result in a screen display 20 of a cursor, also referred to as an object, moving left to right and up, as shown in later FIGS. 10, 11, and 12, with a value of speed proportional to the rate of body movement from the position of FIG. 4 to the position of FIG. 5.

FIG. 6 (this is a new Figure not in '740) depicts body 70 in position to throw a simulated object 77. The concluding position of the throw is not shown. The sensing station basic unit 2 is worn on the wrist. The arm motion, rather than torso motion, determines the screen display. The object 77 is represented as an arrow 77, which travels with the wrist and body unit 2 of the thrower 70. The arrow 77 may be thought of as a vector representing the motion of body unit 2. The effect on the user during exercise is similar to that of throwing a stone, with a direction and speed corresponding to the direction and speed of the arm motion.

The user gets exercise and sees the results of his efforts on the screen 69, and acquires a score or other reward in proportion to the performance. The simulated projectile or the thrown object interacts with obstacles, such as simulated enemies, on the screen in appropriately dramatic ways, with visual and aural electronic outputs, as discussed further in FIGS. 13, 21, and 22.

Figure 7:
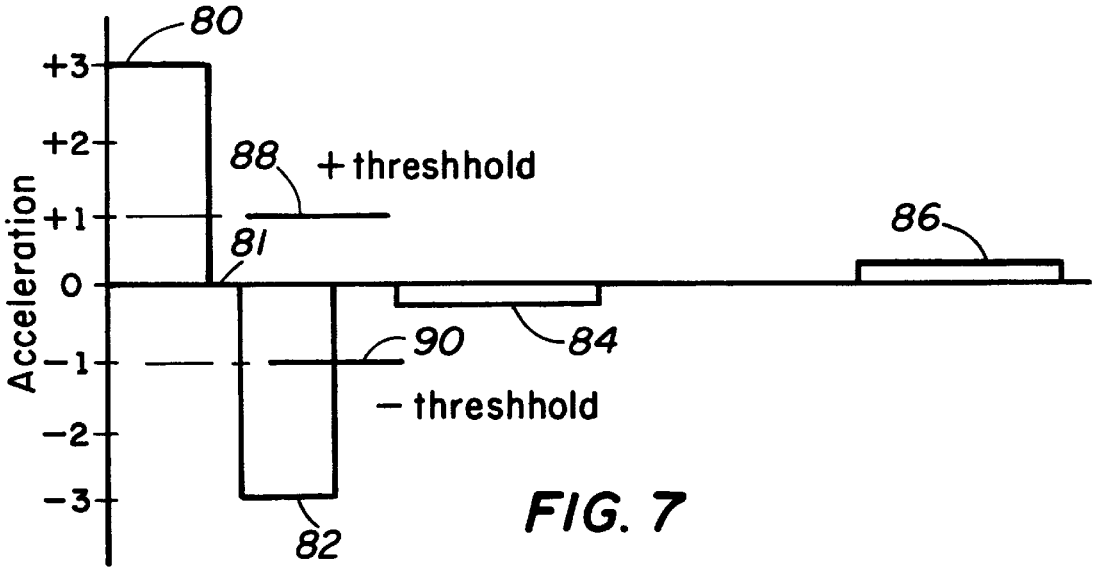
FIG. 7 illustrates an accelerometer signal obtained from a typical thrust and return motion.

FIG. 7 (a new Figure not in '740) shows the typical voltage signals from the X axis accelerometer 30 or 32, as the user's body 70 and hence the body unit 2 moves, over the typical motion cycle between FIG. 4 and FIG. 5. There is first a rapid acceleration 80 followed by an interval 81. During the interval 81 there is no acceleration, and there is no change in velocity, but movement does occur. At the end of the positive body motion there is a reverse acceleration 82. The reverse acceleration 82 is produced when the user's body comes to rest. The body or base unit 2 typically comes to a stop. The user makes a slow return, with a low level of reverse acceleration 84 concluding with a low value of positive acceleration 86, which brings the body to rest at the home position, equal to the starting position shown in FIG. 4.

Figure 8:
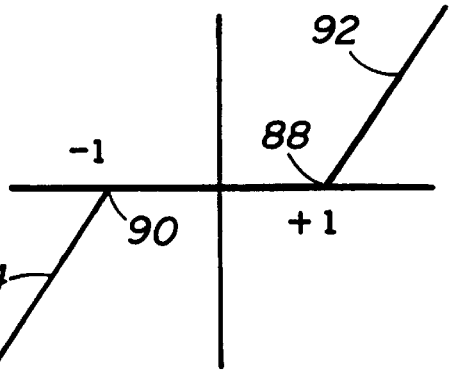
FIG. 8 illustrates a base line suppression input/output curve for the accelerometer signal.

FIG. 8 (new Figure not in '740) shows the threshold or base clipping values 88 and 90 (with values of +1 and −1) applied to signals 80 and 82. If entering curve of FIG. 8 with a value 80, only signal values greater than threshold level 88 are passed on for later processing, with a value diminished by the value of 88. For negative values such as 82, only signals less than threshold value 90 are passed on, diminished by the value of 90. The example value of signal 80 is 3 units, and the value passed on is 2 units. For negative values, the example value is −3, and the value passed on is −2 units. See FIG. 9 later for the plot of these values.

The afore described threshold level function, also referred to as base clipping, zero suppression, or hysteresis, accomplished in function blocks 54 and 56, and referred to as a base clipper, is equivalent to that found in all logic families. That is, in logic families, the base line, or input, is known to fluctuate, due to phenomena such as white noise, base noise, and signal coupling to the base line from neighboring logic circuits, but the logic circuit is designed to not respond until the input rises above a certain threshold. All values below this are ignored. A difference is that logic families are usually mono-polar, that is, work always on the positive side of zero volts, whereas in this application we include base clipping of the negative side also.

The FIG. 8 function is a graph of this base rejection, but differs from logic switching in that the linear part, or overall output, retains a one-to-one relationship with the input, after the base line clipping. FIG. 8 represents the function accomplished in blocks 54 and 56.

Base line clipping is also analogous to one of the techniques used to make digital sound reproduction less noisy than analog reproduction. The "hiss" of analog amplifiers is the white noise, which is below the response threshold, and in digital amplification this hiss noise rejected. The base line clipping function is also analogous to that of hysteresis, or "stiction", in that there is no output until the input signal rises above a certain minimum value. "Stiction" is analogous to pulling a friction load over a surface. There is no motion until the pulling force rises above the threshold value For practical programming attainment of the function of base clipping, as shown in FIG. 8, also called zero suppression, or hysteresis, the function is accomplished with the following programming command. The example command is the logic command used in the spread sheet system EXCEL. EXCEL offers the conditional 'IF" function. The IF function reads: If (A>B,G,Z). That is, if value A (acceleration) is greater than value B (threshold), insert G. If value A is not greater than B, insert value Z.

To accomplish the complete function of FIG. 8, let the input acceleration be A, and the suppression threshold be B. Then when A is greater than B, insert the value A−B. When A is less than B, insert 0. This takes care of the right hand side of FIG. 8. For the negative side, IF −A is less than −B, insert −(A−B). In practice, the left and right hand side are combined into one line programming command, to read:

IF ((A>B), (A−B), IF (A<−B), (A+B), 0)).

The input output plot of FIG. 8 shows this zero suppression relationship. The useful output regions are 92 and 94. Values smaller than one unit, such as signals 84 and 86, are not passed on for further processing. Signals 84 and 86 are less than one in value and are deleted by the base clipping blocks 54 and 56, and do not get integrated. The effect known as "Base Clipping" means the base portion of a signal is removed. "Base Clipping" is sometimes referred to as "hysteresis" because the effect is similar to the magnetic hysteresis curve, where motions below a certain threshold are ignored FIG. 9 (new Figure not in '740) shows the results from example values of acceleration. Three units of acceleration are assumed for FIG. 7, and a base clipping value of one assumed for FIG. 8, leaving a resultant acceleration output of two units in FIG. 9.

Figure 9:
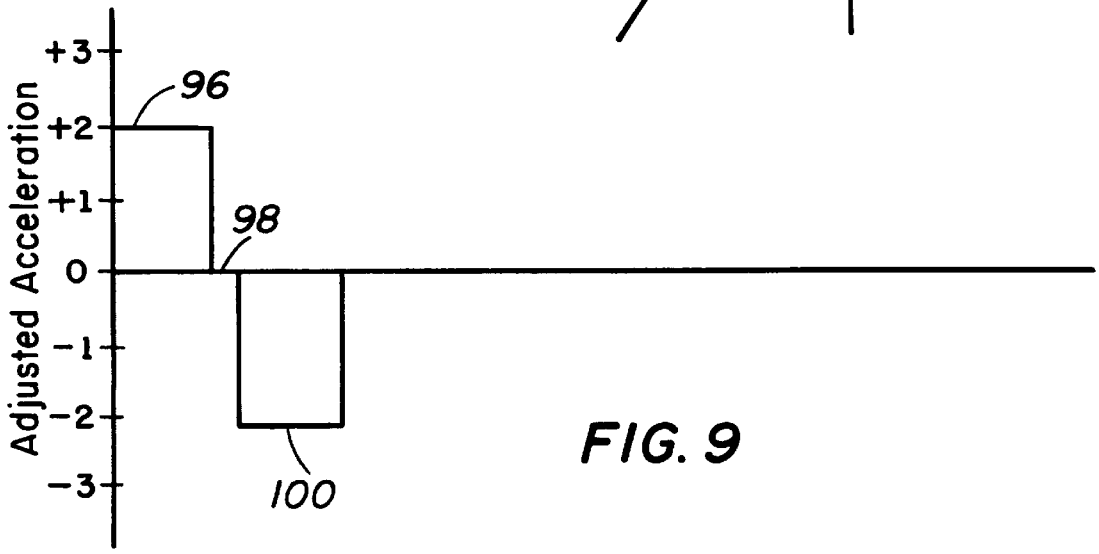
FIG. 9 illustrates an accelerometer signal after base line clipping.

The accumulated effect of these steps on the X axis acceleration signal are shown in FIG. 9. There is only a positive acceleration 96, a pause 98, and then an equivalent reverse acceleration 100. Accelerations 84 and 86 do not appear. The acceleration profile of FIG. 9 brings motion to a stop in some new position, as shown in FIG. 10.

FIG. 10 (new Figure not in '740) shows the position change brought about by the acceleration picture of FIG. 9. When acceleration 96 is constant and positive, the velocity builds linearly per curve 102. The velocity plot is shown by broken lines 102 and 104. When acceleration is negative and constant, the velocity decreases linearly, per curve 104. (The acceleration pause 98 is not shown; but if present there would be a flat top on the velocity curve.)

Integrating the velocity profile produces the position curves 106 and 108. The position curve actually equals ½ acceleration times time squared. The squared term produces a square law (parabolic) increase in position, shown as curve 106. When acceleration reverses, with value represented by 100, the velocity 104 decreases, and the position 106 continues to increase, although at a gradually slower rate. The second curved half of curve 108 is equal to the initial half 106 only inverted vertically. Motion comes to rest at a new position 108. The vertical axis of the plots of FIG. 10 represent both velocity and position.

Note that the velocity plot has a triangular or pyramidal shape. The equation is V=at. The final position 108 is the integral of the velocity. The integral of V=at is X=(1/2) at^2.

Note that the plot of position is for the first half 106 an increasing parabola, and for the second half 108 a decreasing parabola. At the conclusion of the cycle, acceleration is zero, velocity is zero, and there is a new value of position.

The preceding describes the behavior of the X axis transducers and associated display.

Figure 11:
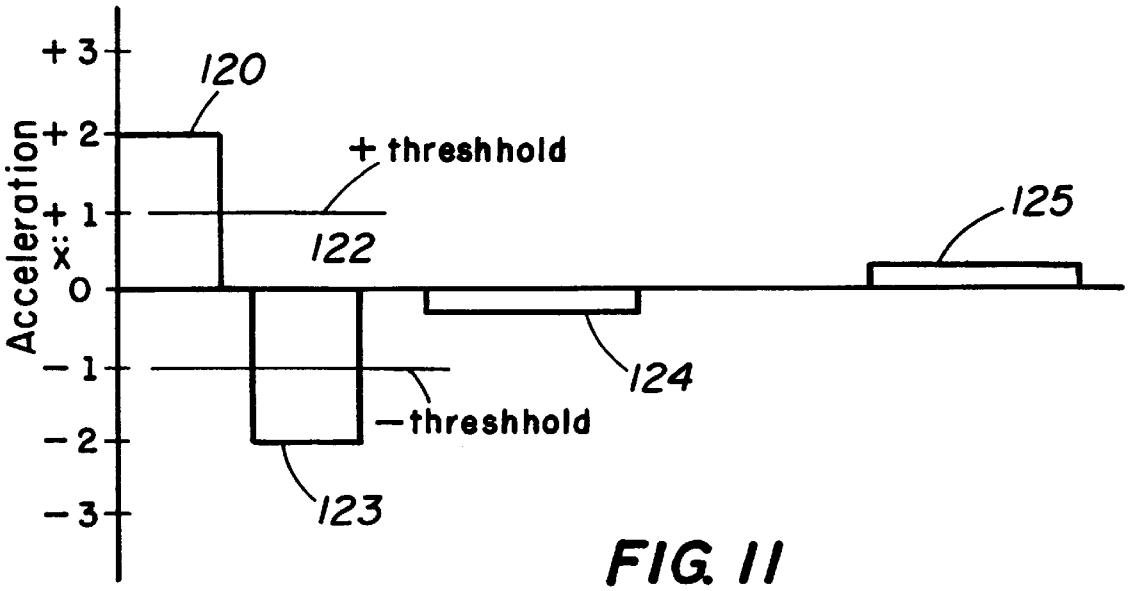
FIG. 11 illustrates Y axis acceleration.
Figure 12:
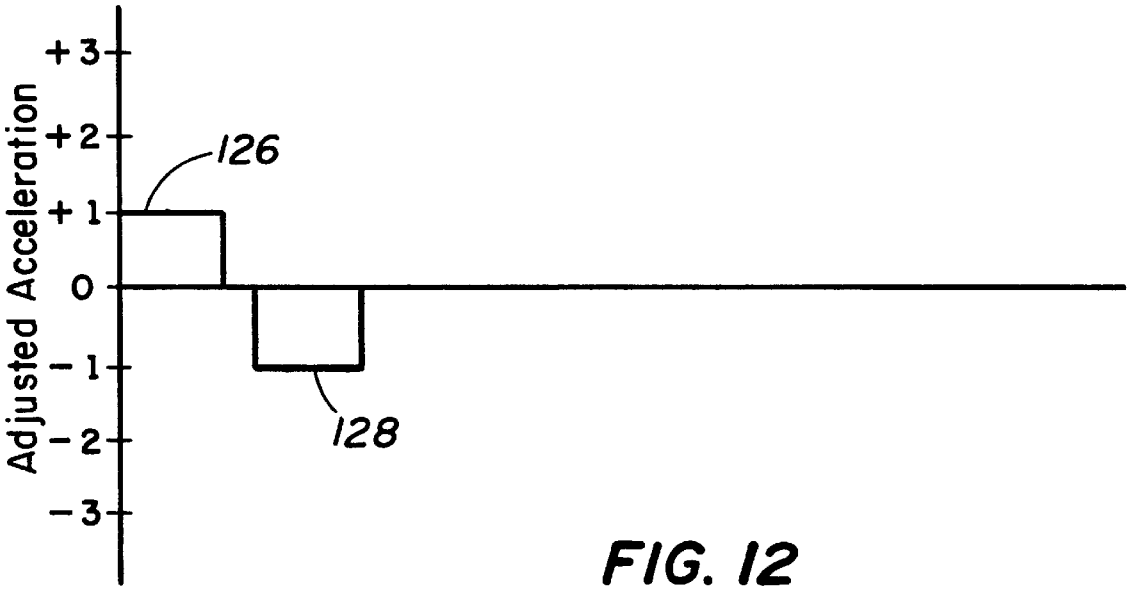
FIG. 12 illustrates Y axis adjusted acceleration.

FIGS. 11 and 12 (new Figures not in '740) describe the parallel equivalent behavior of the Y axis. There is a Y axis acceleration 120, a Y velocity, and a Y motion. There is a pause 122 corresponding in time to pause 81 in FIG. 7. There are return accelerations 124 and 125 corresponding to return accelerations 84 and 86 in FIG. 7, and these are suppressed by base clipping as in FIG. 8.

A total acceleration value of two units is assumed for the Y axis, prior to base clipping. As shown in FIG. 12, the Y axis positive and negative acceleration values, after base clipping, are one unit each, referred to by 126 and 128.

Figure 13:
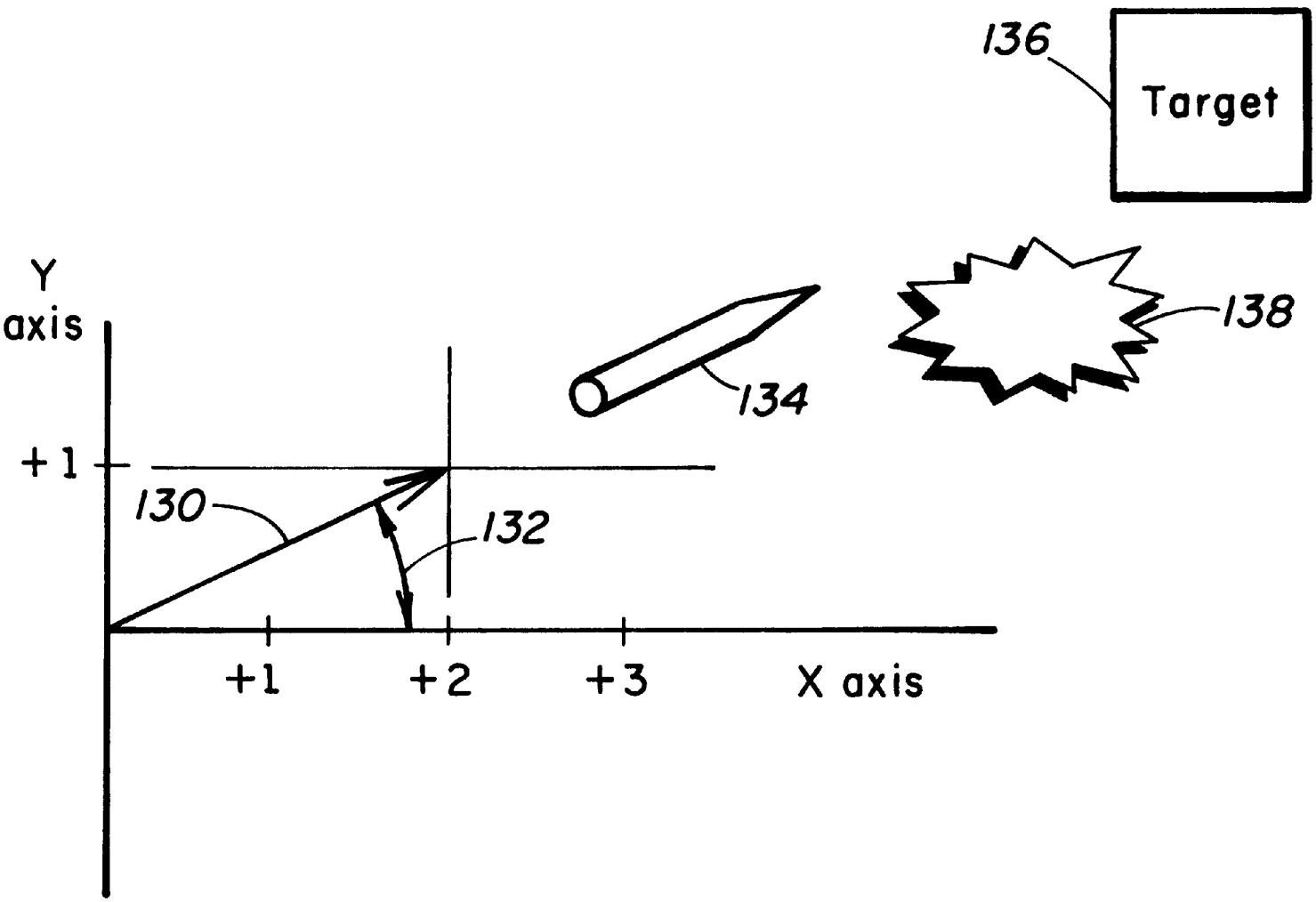
FIG. 13 illustrates a resultant angle and velocity of imaginary game projectile.

In FIG. 13 (new Figure not in '740) the final combined X and Y axis acceleration values are shown. The value of two for X and one for Y leads to a net projectile acceleration of 5^(1/2) (square root of five) units or 2.236, at an angle of 26.5 degrees. This result is represented by vector 130 at the angle 132. The acceleration is integrated to be a velocity in integrator block 60.

In a game, a projectile 134 or object will travel at the acceleration 130 and corresponding velocity and at the angle 132, with an impact proportional to velocity, and with a consequent proportional explosive entertaining sound and visual picture on the screen. It will be aimed at target 136 and may encounter defensive action in the form of obstacle 138.

Figure 14:
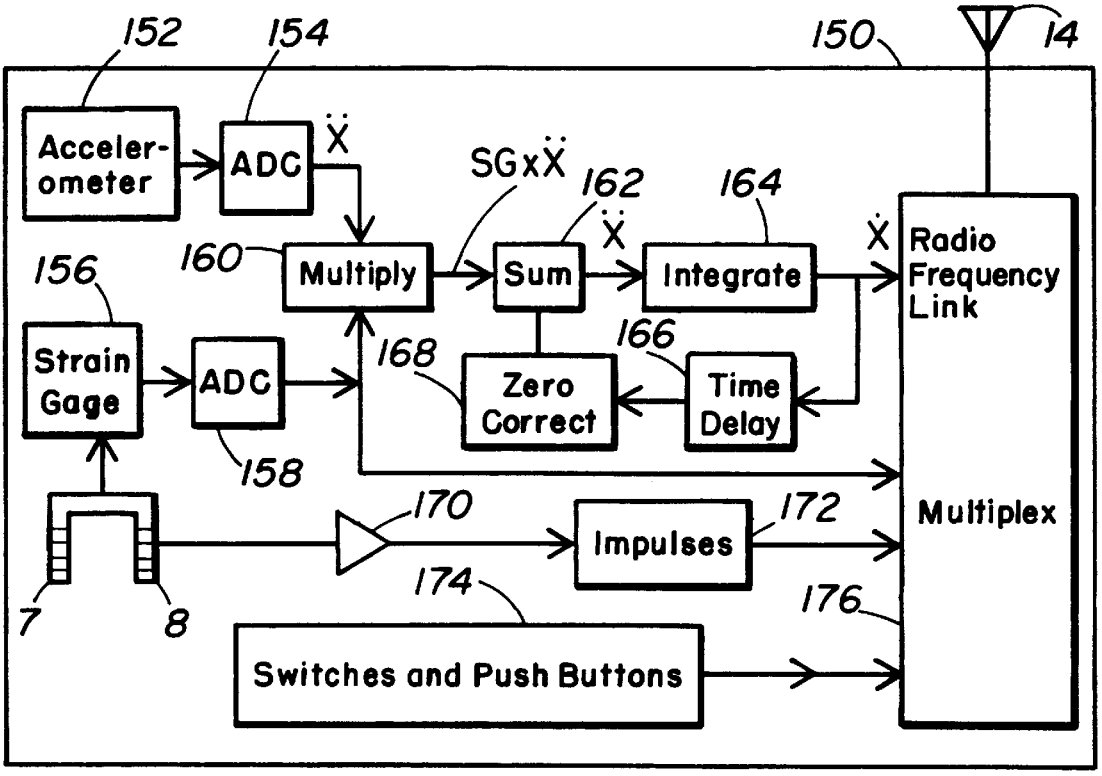
FIG. 14 illustrates an alternative block diagram of the body unit, showing one axis.

FIG. 14 (referred to as FIG. 2 in '740) is an alternative form of the body unit 2 and is referred to by the general number 150. Some portions of the transducer data processing are done in the body unit 150, rather than later in the base unit 180. For example, one advance in game play is to emphasize acceleration values according to the force applied to the hand strain gage 156. The acceleration reaction from accelerometer 152 is converted to digits in ADC 154, and the strain gage 156 reading is converted to digits in ADC 158, and the two value are multiplied in a multiplier 160. A user gets multiplied reaction from his acceleration effort by simultaneously applying pressure to the hand grips. The game is thus made more exciting and there is additional exercise value from the need and use of muscular pressure on the hand grips.

Errors will arise in both accelerometer and strain gage outputs. A common form of error is called a "zero offset", which means that when acceleration and strain are zero, in the absence of acceleration or strain, there is still a small output from the transducer. This type of error is corrected for in summing device 162, the function of which will be explained later.

FIG. 14 (referred to as FIG. 2 in '740) shows integration of the accelerometer signal, labeled X-double dot, in integrator 164. Integration of acceleration equals the velocity, labeled X(dot). The dot notations are Newtonian notation for first and second derivatives. The velocity value is sent to an output device 176, which transmits readings either via cable or radio transmitter. FIG. 14 depicts the output as being radio frequency link of 176 to antenna 145.

FIG. 14 (referred to as FIG. 2 in '740) also shows automatic zeroing of the accelerometer transducer signal. Automatic zeroing is needed because accelerometers are quite sensitive and inclined to zero drift with temperature changes or with aging. During periods of idleness, rest times, or startup, the system is automatically zeroed. The selective timing of the automatic zeroing function is not shown. During rest periods or non-operating periods, the value from the accelerometer 152 via multiplexer 160 is integrated in integrator 164 and fed back through a time delay 166. The value is stored in zero correct storage 168. The zero correction is subtracted in block 162 from the main signal. The results is zero output from 162 during idle periods, as it should be. This type of correction principle is also known as negative feedback for auto zeroing purposes. Offset drift errors from the accelerometer and strain gage are rejected early in the data processing stream at the originating point, namely in the body unit 150. The time delay 166 is inserted to avoid oscillations around the zero correction closed loop FIG. 14 (referred to as FIG. 2 in '740) also shows the path of the hand electrode voltage signals from handles 7 and 8. The electrode signals represent both cardiac muscle potentials and hand muscle potentials, both of which are accentuated during tight gripping. These voltages are amplified in amplifiers 170 and 172 and are transmitted to the base station 17 with the other transducer data by radio link 176 and radio frequency antenna 14.

Switch and push-button data sources are held in element 174. These are under control of the user, who may, for example, choose to fire a projectile 134 at the time when he believes his aim is good.

Figure 15:
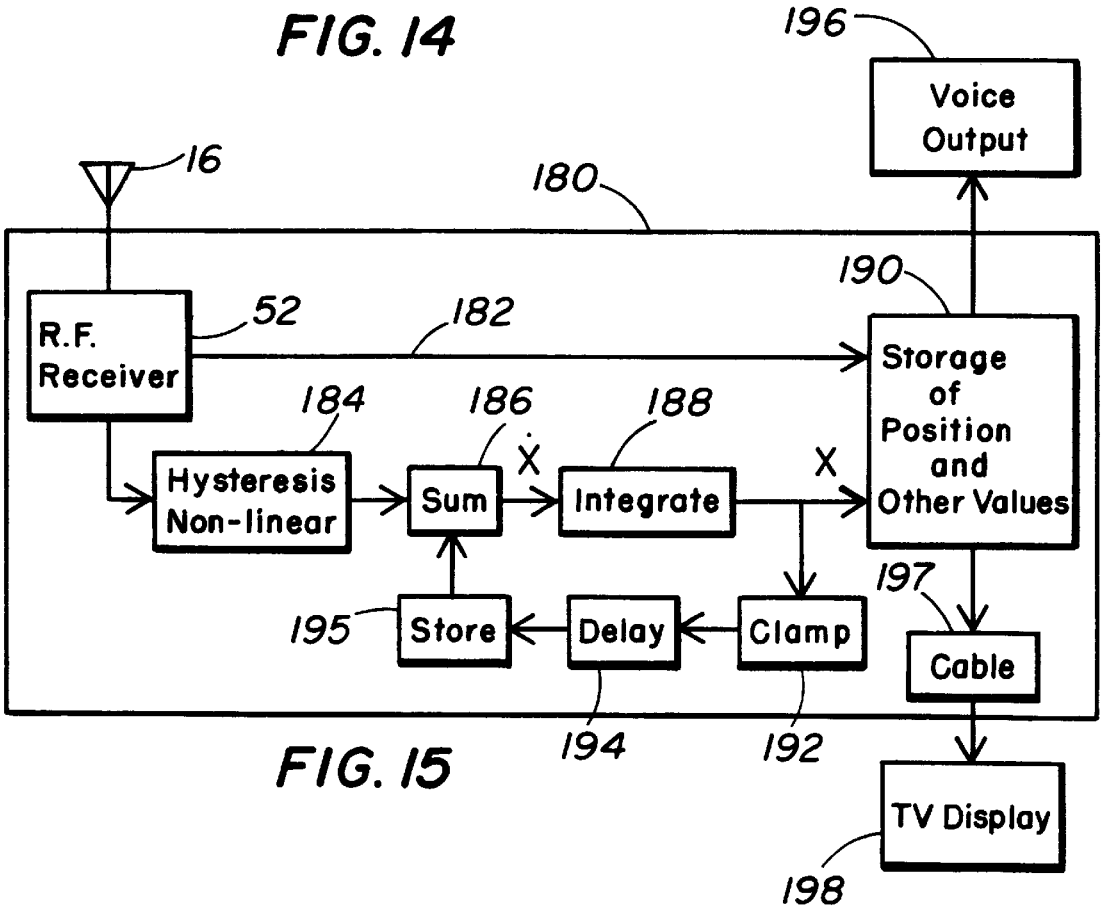
FIG. 15 illustrates an alternative block diagram of the base station, showing one axis.

In FIG. 15 (referred to as FIG. 3 in '740) there is an alternative configuration of a base station and referred to by the general reference character 180. Data enters on the antenna 16. The modified velocity signal X(dot) is passed through a summing element 186, explained later, to an integrator 188. Integration of velocity produces position X. The integrator 188 value is stored in storage block 190, and is transmitted, typically by cable 197, to a television type display screen 198. The display cursor is positioned by this signal. The base station 180 built-in micro-processor also adds related sound and music from element 196.

After the R.F. receiver 52, the signal is passed through and clipped in the non-linear base line clipping block 184. This clipping is done in block 184. FIGS. 16 to 20 describe the dynamics associated with this velocity base line clipping.

Also, in FIG. 15, (referred to as FIG. 3 in '740) the velocity value is automatically zeroed, during idle or non-functioning, times. The velocity value received from block 184 is passed through summing element 186, described later, and integrated in block 188 to produce a position signal X. During non-functioning times, such as immediately after the system is turned on, any zero drift value is held in clamp 192, delayed 1 to 20 milliseconds in 194, and is stored in 195, and summed negatively in block 186. The effect is to delete "zero drift" errors from accumulated instrument errors in the velocity readings. By "zero drift" is meant the tendency of practical systems while at rest to accumulate small errors, from the effects of temperature and time. ("Zero drift" is similar to a bathroom scale tending not always to read zero when there is no weight upon it.) The clamped and stored value is held as a zero correction term, during changing data times, until another idle opportunity is available for re-zeroing. The blocks 192, 195, and 186 correct for this zero error. The delay 194 is needed to avoid oscillation around the loop. The zero command value is held in storage 195 for the length of the exercise program, or until there are functioning gaps long enough for another re-zeroing cycle.

In FIG. 15 (referred to as FIG. 3 in '740), there is an optional data path line 182 directly to storage 190. This path will function but is less accurate and more confusing to the user. Use of this path requires more data processing by the micro-processor in block 190.

A typical exercise movement consists of a rapid motion in the desired direction, followed by a slow return to the starting point. The conscious goal is to advance the cursor with rapid powerful motions in the desired direction, each such motion followed by slow gentle returns which do not move the cursor. Exercise action coincides with the motion. The related dynamics are described in FIGS. 16, 17, 18, 19 and 20, (referred to as FIGS. 4 through 8 in '740) as follows.

FIG. 16 (referred to as FIG. 4 in '740) shows the velocity profile 200 of typical user body motion during competitive exercising. There is first a sharp rise in velocity, the velocity is sustained at the peak, and then rapidly reduced to zero. This corresponds to a forward pumping action by the user as the user attempts to advance the screen image of his position.

It is next necessary to return the body to its original position, or near to it, to avoid leaving the neighborhood. By "neighborhood" is meant the visual vicinity of the display or TV device 198. The second portion of FIG. 16 labeled 202 shows the return velocity. The return velocity is smaller, so for full return, the fact that this value is much less, means that it must persist for a greater period of time. Note that 202 is longer in time than 200.

FIG. 17 (referred to as FIG. 5 in '740) illustrates the signals which are generated by the accelerometer 30 or accelerometer 152 to create the plot of FIG. 13. Note that the accelerometer signal 206 is the acceleration necessary to produce a steadily increasing velocity, between times 1 and 2. There is then zero acceleration between times 2 and 3, and there is no increase in velocity. Then, as the user brings the movement to rest, there is negative acceleration 208 between times 3 and 4, and a velocity which decreases to zero . . . . During the slow return motion, referred to as 202 in FIG. 16, there is first a negative acceleration 210 for a brief period of time, in interval 5 to 6, and then a lengthy slow negative velocity 202 with zero acceleration, and then a brief positive acceleration 212 in times 7 to 8, to bring the unit to a stop.

The user's goal is to display progress on the screen, over multiple cycles, and yet his physical body must stay in the neighborhood of the screen. The computing system double integrates the forward stroke and moves the image on the screen forward. During the return stroke, there is reverse acceleration and integration, and if no system precautions are made, the screen image will return to the starting point.

The display cursor would always return to the starting point and the desired progress on the screen would not be made.

FIG. 18 (referred to as FIG. 6 in '740) shows the motion of the Body Unit 2 associated with these accelerations and velocities. There is first a parabolic rise as velocity increases, then a steady velocity, then a parabolic slowdown. The return stroke applies the acceleration only briefly, so less velocity is developed, but the stroke takes longer since the velocity is less. Note that the position 214 of the device is returned to the original position, in preparation for another cycle. Return to zero is required so that the user need not travel to remote parts of the exercise area and lose sight of the display The function of net gain on the display per each stroke is accomplished by deleting the acceleration and velocity factors on the return stroke. The return action is deleted by using velocity base line clipping. The clipping values are values 204 and 205 in FIG. 16 and values shown as corresponding inflection points 204 and 205 on FIG. 19 (referred to as FIG. 8 in '740). These represent the base line clipping function—any value less than these thresholds is deleted. Therefore strong forward signals are passed, and weak but lengthy return signals are deleted.

For overall game use progressive motion across the display is desired, and not return to zero, even though the user does return to zero, also called home position. This desired goal is achieved by ignoring low velocities 202 and passing on high velocities 200. The clipping region or dead zones are shown in FIG. 19 (referred to as FIG. 7 in '740). Any value between points 205 and 204 is ignored.

Referring again to FIG. 19 (referred to as FIG. 7 in '740), the input velocity is on the horizontal axis, and the output velocity is on the vertical axis. There is a dead zone between velocity levels 204 and 205. The dead zone means that the low velocities between 204 and 205 are not passed on to the next stage. Thus the effects of slow motions are eliminated. If the user holds the velocity below a certain threshold, there is no integration of velocity to position, and no effect or motion of the cursor display. Such a relationship or dead zone is referred to as "base line clipping', or deletion of the base line.

In other words, to make progress on the final position display, it is necessary that the weak reverse velocity 202 be eliminated. The slow return velocity is not noticed by the later parts of the electronic processing.

Refer next to FIG. 20 (referred to as FIG. 8 in '740). Each time a user executes one more acceleration/deceleration cycle, the displayed position value 216 advances. Curve 216 of FIG. 20 differs from curve 214 of FIG. 18 because the return acceleration and return velocity is suppressed. The peak value of 216 is retained and held in storage 190. The cursor of display 198 thus is manipulated by the user to any position on the screen, yet the user remains physically in the neighborhood of one position on the ground.

During exercise action, the integrated velocity value, representing position, is held in position value register 190. As successive exercise cycles occur, the position value is incremented and accumulated. In FIG. 20 (referred to as FIG. 8 in '740) portion 218 of curve 216 represents the beginning of the following cycle of position advance.

The foregoing describes the functioning of a single axis, labeled the X axis in the user display. There is a duplicate set of elements for the Y axis. The two together position the cursor in the X and Y directions on the screen for the final display 20. The cursor can be made to move left and right, up and down, for various distances on each move, and for any quantity of moves, to anywhere on the television screen.

Figure 21:
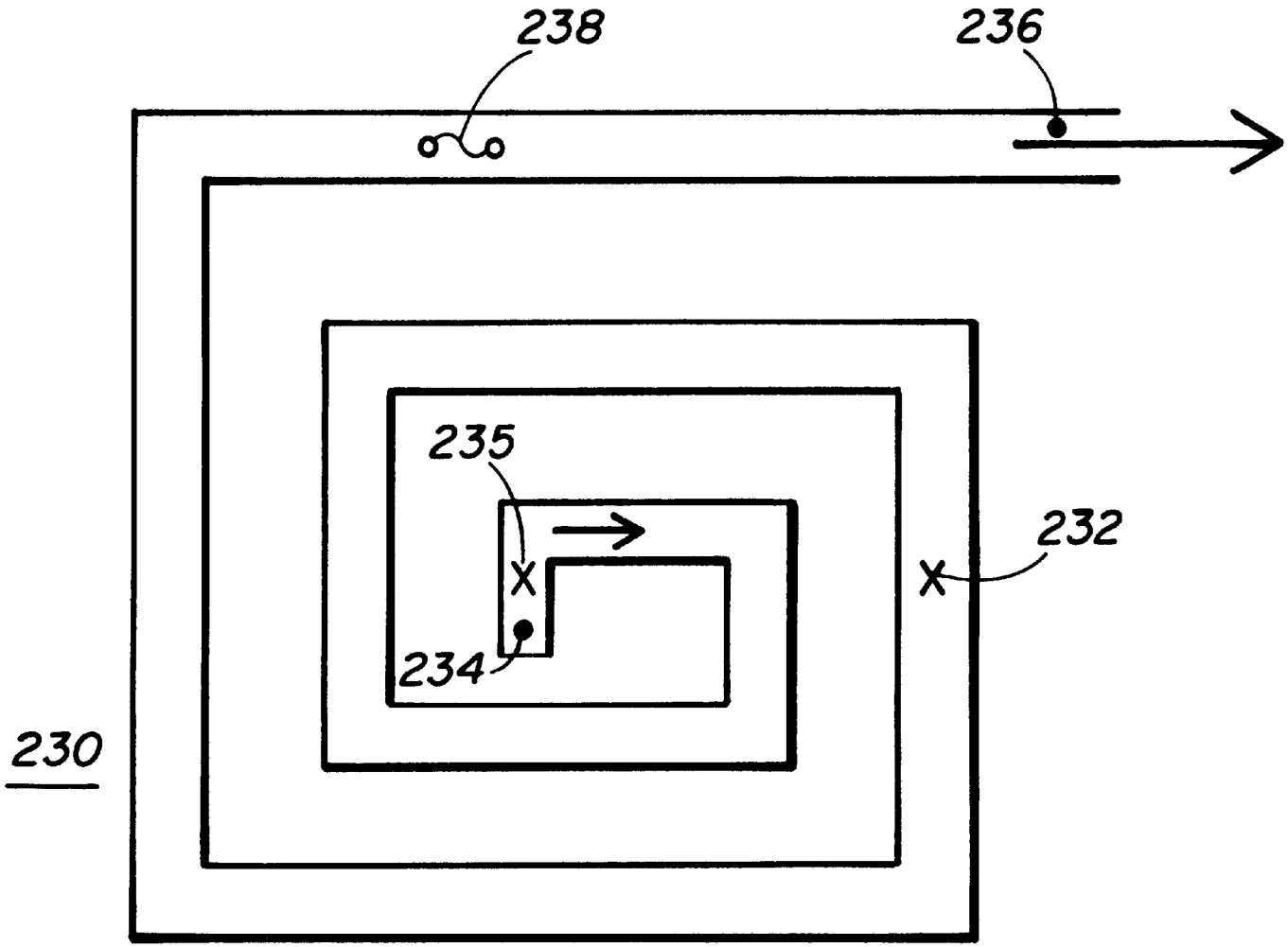
FIG. 21 illustrates an example maze for the user to follow.

FIG. 21 (referred to as FIG. 9 in '740) shows one form of a track 230 which the user attempts to follow. There is a pathway 232 which spirals away from the starting point 234. There is a finish point 236. The cursor X 235 may take the form of a cartoon character, such as a runner. The facing direction of the cartoon will change as the overall direction changes. If a cursor should be driven outside of the path 232, there is a penalty such as a setback or a restart. There is dramatization of the action by appropriate facial expression changes and body position changes, and there are obstacles such as 238 which increase the entertainment value and avoid boredom.

Figure 22:
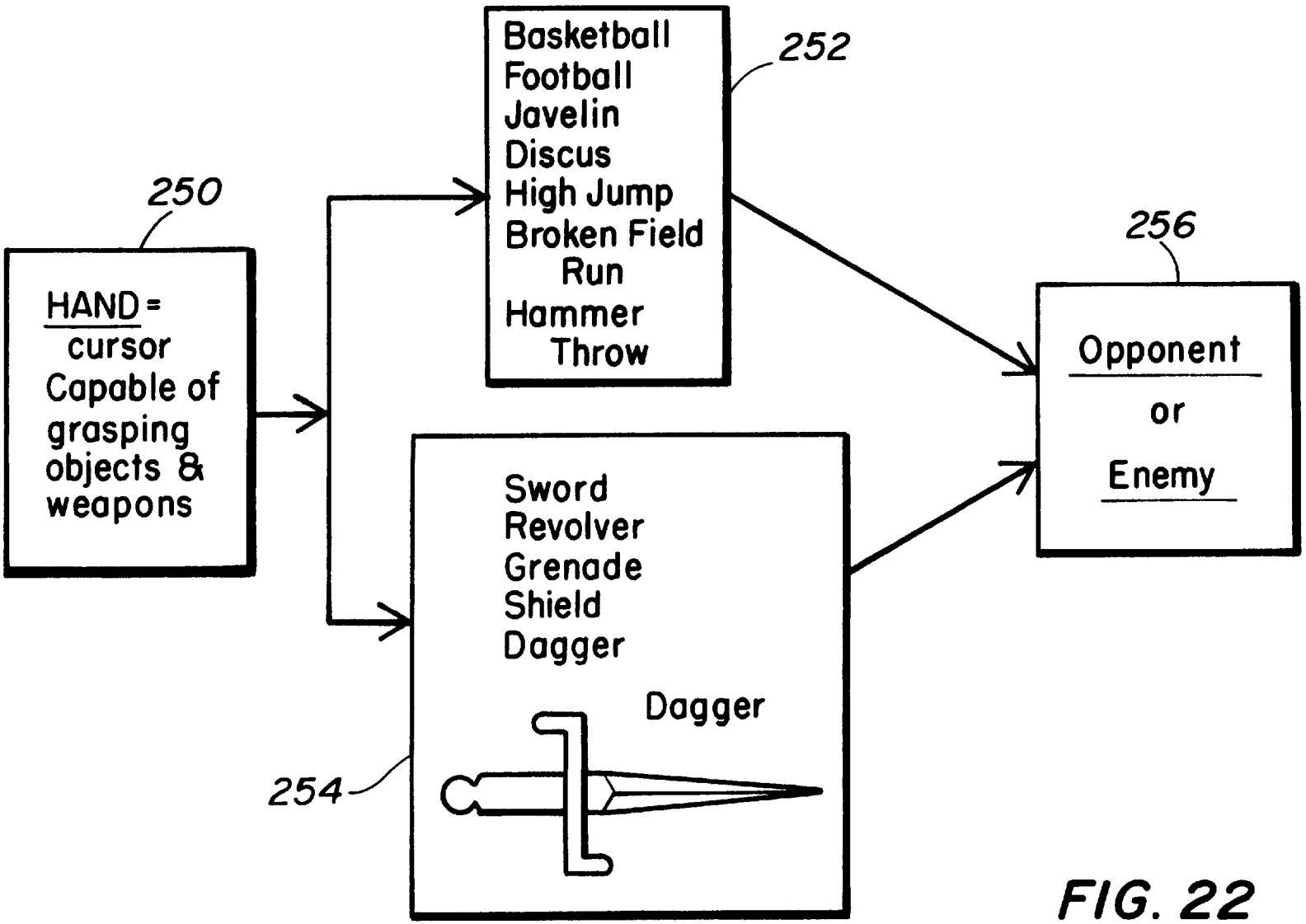
FIG. 22 illustrates examples for alternative competitive games using tools, weapons, challenges, miscellaneous devices.

FIG. 22 (referred to as FIG. 10 in '740) shows the game possibilities which may be combined with exercise. The cursor appearance may be a hand 250 or the equivalent. Available to place in the hand are selections of athletic devices 252 or weapons 254. There is an opponent 256, who take evasive action and aggressive action. The user moves his body in a way appropriate to the device selected. One of the switches represents the trigger of a gun, and the direction of firing is determined by the direction of motion of the cartoon body 70 in FIG. 6, which is in turn determined by clever movements of the user's body. After the various motions and electronic manipulations, the screen display gives a report on the level of success achieved. There are appropriate sounds, such as grunts, gunshots, crashes, "Touche", "En Guarde", "touchdown", scoring and time keeping announcements, and cheers for good performance, etc., as encountered in arcade games . . . . The system is more simple than that required for Virtual Reality movements, and it is more comfortable because a head piece is not worn.

PRACTICAL IMPLEMENTATIONS:

A suitable choice for the accelerometer (30–33 of FIG. 2) is the model AXDML made by the Analog Devices Company of Norwood, Mass. This accelerometer model delivers two analog voltages representing both X and Y axis acceleration values. The operating principle is as follows. For each axis, there is a small mass, which is attached by a flexible spring member to one plate of a capacitor. As the device 2 moves, the internal mass behaves in an inertial manner, and moves relative to the housing, and the capacitor plate moves with the mass, so that capacitance varies in accordance with the acceleration of device 2. The varying capacitance is connected to a fixed inductance, forming a resonant tank circuit. The resonant circuit is excited by a non radiating oscillator. One center frequency value is 50 kilohertz. Varying acceleration varies the value of the capacitance and hence varies the natural frequency status of the tank circuit, resulting in more or less proximity to resonance. The resonant point moves away from or towards the excitation frequency of the oscillator, and the oscillator sees a load which varies with the nearness of the accelerometer resonant circuit to the oscillator frequency. There is then more or less current flow from the reference oscillator. The varying current flow is converted to a voltage across a resistor. The overall effect is a voltage which varies, both plus and minus, in accordance with the acceleration of the body of the accelerometer, which is the same acceleration as that of the body device 2.

When excited with the specified five volts, the output of the accelerometer varies several volts either side of the three volt center position, representing plus or minus acceleration values. For full scale acceleration the output ranges between plus 4.5 and plus 1.5 volts, with three volts representing zero acceleration. The AXDML model is a dual axis model, with both X and Y accelerometers inside, so that there are two analog voltage signals, representing the two axes. For three axis measurement, a second model is used, with one accelerometer dedicated to the Z axis, and the other axis redundant to either the X or Y axis.

The output of the accelerometer is fed to a commercially available computer input card, such as the Keithley Metrabyte DAS800. This card includes an analog-to-digital converter 40 (see FIG. 2) on the input side, and a digital output to the base station 17 and display 20 (see FIGS. 1, 3, and 14) on the output side. The card reads data continually, at 20 to 200 repetitions per second, so that continually at this repetition rate there is fed to the computer memory a digital value, plus or minus, representing the accelerations to which the accelerometers 30 to 33 and 152 are subject.

The foregoing presumes a cable 41 connecting the output of the analog to digital converter to the base station 17 and display 20. The cable 41 carries the data flow. In a more advanced more costly embodiment, the cable 41 is replaced with a radio frequency linkage, formed of elements 44, 42, 14, 16 and 50, as discussed under FIGS. 2 and 3.

Transmission of digital data is by now well established. One means for digital transmission is that used by cordless phones during the dialing cycle. Data in a large factory complex is collected by low power digital data transmission. Digital data is also radio frequency transmitted by the more sophisticated lap top portable computers. Radio frequencies which are preferred include the Citizens Band "CB" frequencies centered around 27 MHz; and the cordless phone frequencies, which are 49 MHz, and also 900 MHz. Another band available for exercise use is the 76 MHz band used for digitally controlling model boats and airplanes For a strain gage input, a good choice is the model SS-080-050-5008-S1 made by the Micron Instrument Company of Simi Valley, Calif. This model outputs a ten millivolt signal which is amplified to four volts DC. The voltage is brought into the base station 17 and display 20 via the same analog to digital converter 40 and cable 41. The multiplexer 38 connects to each analog input in turn and the analog voltage are fed in turn to the Keithley card with its analog to digital converter 40.

Temperature is sensed with either a thermocouple or with a resistance bulb thermometer. The latter is preferred because it delivers a larger voltage and doe not need a cold junction. A number of manufacturers make resistance bulb temperature sensors.

The other data source 35 includes heart beat detection by the plates 9, 10, 11, and 12, also referred to as electrodes. Small DC voltages are produced by the muscle potentials within the human arm and these voltages couple through the skin of the hand to the electrodes. The voltages are amplified to the five volt level and then to the multiplexer and then to computer memory. An instrument using these electrodes to sense heart beat rate is the Model 107 "Instapulse" heart rate monitor made by the BioSig Instrument Company of Plattsburgh, N.Y. This model of the instrument includes a small microprocessor which converts the electrical pulses of the electrodes to a digital expression of the heart rate. The useful output of this instrument therefore feeds to the logic data bus without need for an analog to digital conversion. The Keithley Metrabyte DAS800 card has digital input paths to the PC.

PROGRAMMING INNOVATIONS TO REDUCE NOISE:

Accelerometers are sensitive and produce unwanted output fluctuations from small events such as muscle spasms. The stages of integration amplify these fluctuations to a large error. One means for rejection of the effect of the unwanted fluctuations is to choose a larger size dead zone, but this is at the risk of loss of data. A second preferred method is to multiply velocity and position increments by a coefficient less than one. The coefficient is made dependent upon system conditions. In particular, if the accelerometer reading or the velocity value falls below the dead zone limits, and is therefore zero, this zero value is used as a multiplier. Thus troublesome excess integration is brought to a halt.

EXTENSIONS AND VARIATIONS

Advanced Game Playing and Multi Cursor Competition:

Multiple users compete with one another. There are two or more cursors, each with a cartoon representation of a runner or a horse, bearing various weapons or athletic devices, on a steeplechase track, or greyhound track, or fox and hound countryside. Individuals compete with one another, using motions compatible with their body mounted unit and hand held devices, and apply vigorous body motion, and tension their hands and shoulders, to advance their respective cartoon representations, using muscles appropriate to the selected sport.

Two or More Players

Two or more users compete, with or without touching. The accelerometers report the motions, including the particularly large reverse acceleration signals which occur when bumping into one another. Users may race, and bump one another off course, or push or pull someone in a reverse direction, or into impediments.

When two or more persons use the system, there are two or more radio frequencies, or two or more sub-carrier signals. There are independent systems for the added users. All users display on the same television screen. One embodiment for multiple users allows independent access for each user system to the same display screen memory.

Third Dimension

A third dimension is introduced on the screen. Distance scenery and perspective lines are added. The screen can display objects moving towards the user, such as a basketball or a projectile. The user is expected to observe this object and take responsive action to score game points.

Body motion towards and away from the screen will also control this dimension. The cursor display shrinks and enlarges with distance.

Gyroscope Addition

Include gyroscopes in the body device 2. These will report body position, which is in turn used to increase realism in the visual display.

Allocation of Functions

The various data processing functions between the instrument sensing and final display may be housed either in the body unit or in the base station, or even as part of the display, and need not be allocated as shown in the embodiment of FIGS. 1, 2 and 3.

Results by Visual Displays or Audible Report

Attached to the cartoon Figures and to the screen will be numerical values showing speed, direction, acceleration, scoring status, power remaining, strokes achieved, etc. There will also be audible reports.

Gymnasium Use:

The user, when striving or competing, will strive to maximize the user's position advance on each exercise cycle. The user must stay within viewing distance of the visual results monitor 20. Viewing distance will depend upon the size of the screen, so for example, in gymnasium displays with multiple contestants, there will be large screen with lots of room to move around. For a small home screen, the neighborhood will be only four or five feet.

Added Exercise

For added exercise, the exercise burden is increased by either wearing weights on various parts of the body, or with elastic restraining ropes to nearby points in the exercise area.

What is claimed is:

1. A method of exercising a human body while simulating an athletic activity or game to be part of said exercise appearing on a display means comprising the steps of:

providing a portable sensing unit adapted to be coupled to said human body to sense a muscled body area activity, said sensing unit including a first means for sensing said muscled body area acceleration and direction, a second means for sensing muscle tension for indicating said muscled body area forces and a third means for sensing pulse-rate, moving said muscled body area so that each of said first, second and third means provides signals indicative of activity of said muscled body area, encoding said signals from said first, second and third means with an encoding means in said sensing unit into a form for transmitting from said sensing unit;

transmitting said encoded signals from said sensing unit by a transmitting means in said sensing unit to a base unit and monitor, said base unit including a decoding means and a data processing means;

decoding said encoded signals from said sensing unit with said decoding means into data signals representing said muscled body area activity signals;

processing said data signals from said decoding means with said data processing means for translating each of said muscled body area activity signals from said first, second and third means of said sensing unit to be part of a simulated athletic activity or a game programmed within said data processing means; and displaying said simulated athletic activity or game on said display means so that the actual activity of said muscled body area appears to be part of said simulated athletic activity or game complete with all the paraphernalia and trappings associated with said athletic activity or game;

whereby the simulated athletic activity or game combined with the actual muscled body area activity provides an entertaining exercise in which a user is part of said simulated athletic activity or game.

2. The method of claim 1 wherein said first means for sensing said muscled body area acceleration comprises: attaching a belt means to the torso area of said human body, said belt means including first and second accelerometers for measuring acceleration and direction of said torso in the X and Y axes.

3. The method of claim 1 wherein said first means for sensing said muscled body area acceleration comprises: attaching a strap means to one or more limbs of said human body, said strap means including third and fourth accelerometers for measuring acceleration and direction of said one or more limbs in the X and Y axes.

4. The method of claim 2 wherein said first means for sensing said muscled body area acceleration comprises: attaching a strap means to one or more limbs of said human body, said strap means including third and fourth accelerometers for measuring acceleration and direction of said one or more limbs in the X and Y axes.

5. The method of claim 1 wherein said second means for sensing said muscled body area forces comprises: attaching a strap means to one or more limbs of said human body, said strap means including a strain gauge for measuring muscle tension of said one or more limbs.

6. The method of claim 2 wherein said second means for sensing said muscled body area forces comprises: attaching a strap means to one or more limbs of said human body, said strap means including a strain gauge for measuring muscle tension of said one or more limbs.

7. The method of claim 4 wherein said second means for sensing said muscled body area forces comprises: attaching a strap mean to one or more limbs of said human body, said strap means including a strain gauge for measuring muscle tension of said one or more limbs.

8. The method of claim 1 wherein said encoding means further comprises: a multiplexer and analog-to-digital converter working in combination.

9. The method of claim 1 wherein said encoding means further comprises: first and second analog-to-digital converters, a multiplier, a summing circuit with a zero offset control circuit, an integrator and time delay circuit working in combination.

10. The method of claim 1 wherein said transmitting means comprises: a cable directly connecting said sensing unit to said base unit.

11. The method of claim 1 wherein said transmitting means comprises: a radio frequency oscillator and modulator in combination providing a radio link between said sensing unit and said base unit.

12. The method of claim 8 wherein said decoding means and said data processing means of said base unit comprises: a reverse multiplexer, first and second zero suppression circuits, first and second integrating means connected to respective first and second zero suppression circuits, a vector addition and integration circuit combination and a performance information means all working in combination to decode and data process said encoded transmitted signals to send to said display means.

13. The method of claim 9 wherein said decoding means and said data processing means of said base unit comprises: an R. F. receiver, a hysteresis or dead zone circuit, an integrating circuit, a clamp circuit, a delay circuit, a store circuit and a sum circuit cooperating with a storage of position and other values circuit to decode and data process said encoded transmitted signals to said display means.

14. The method of claim 13 wherein said dead zone circuit functions to suppress low acceleration values, whereby said user may return slowly to a convenient screen viewing position, while said screen display does not show activity.

15. The method of claim 1 wherein said display means is a T. V. type monitor.

16. The method of claim 1 wherein said display means is a set of virtual reality goggles worn as a headband adapted for a user to wear on the head of said human body.

17. The method of claim 1 wherein said data processing means of said base unit further comprises: sound effect circuits and programs as said associated trappings of said data processing means to synchronize with said simulated athletic activity or game, said sound effects include music, crowd cheering and verbal reports directed to stimulate excitement and enhance said entertainment quality of doing said exercise.

18. The method of claim 17 wherein said data processing means programs of said base unit further comprises: video arcade game type programs such as obstacles, elements of engagement and battle as said associated paraphernalia of said simulated game in which said user appears to hold, throw and must overcome in doing said exercise.

19. The method of claim 18 wherein said data processing means programs of said base unit further includes programs to track and display game or athletic activity progress, scores and results so that said user is motivated to strive for improvement in the exercise.

20. The method of claim 1 wherein said portable sensing unit further comprises: metal handles to be gripped by said user, said handles incorporating said first, second and third sensing means for sensing respectively said muscled body area acceleration, direction and pulse-rate.

21. The method of claim 1 wherein said portable sensing unit further comprises: a fourth sensing means attached to said human body for sensing temperature.

22. The method of claim 18 wherein said obstacle of said simulated program responds directly proportional to actual vigor of actions of said acceleration and muscle motions.

23. The method of claim 7 further comprising the step of: multiplying together the acceleration values of said accelerometer and the strain gauge values from said strain gauge with a multiplier means, to create an increased response of said simulated game or athletic activity on said display.

* * * * *